US006249231B1

(12) United States Patent
Uchida

(10) Patent No.: US 6,249,231 B1
(45) **Date of Patent: *Jun. 19, 2001**

(54) RADIO PAGING RECEIVER WITH MESSAGE DISPLAYING FUNCTION AND METHOD OF CONTROLLING THE SAME

(75) Inventor: Jun Uchida, Shizuoka (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/820,070

(22) Filed: Mar. 19, 1997

(30) Foreign Application Priority Data

Mar. 22, 1996 (JP) ..... 8-066373

(51) Int. Cl.[7] ..... G08B 5/22

(52) U.S. Cl. ..... 340/825.44; 340/825.47; 340/311.1; 455/38.4

(58) Field of Search ..... 340/825.44, 825.47, 340/311.1; 455/38.4

(56) References Cited

U.S. PATENT DOCUMENTS 4,786,901 * 11/1988 Matai et al. ..... 340/825.44
4,949,085 * 8/1990 Fisch et al. ..... 340/825.44
5,177,477 * 1/1993 Fennell et al. ..... 340/825.44
5,396,264 * 3/1995 Falcone et al. ..... 340/825.44
5,430,440 * 7/1995 Shim ..... 340/825.47

FOREIGN PATENT DOCUMENTS 4-257127 9/1992 (JP) .

* cited by examiner

*Primary Examiner*—Brian Zimmerman
*Assistant Examiner*—Yves DaLencourt
(74) *Attorney, Agent, or Firm*—Scully, Scott, Murphy & Presser

(57) ABSTRACT

A radio paging receiver which stores messages accompanied by paging calls into directories corresponding to paging numbers and displays the stored messages in a particular directory together and successively, in which the directory which has the highest preferential ranking to display stored messages is determined by an user of the radio paging receiver, or from among the directories which correspond to a plurality of paging numbers selected by the user the highest preferential display ranking is given to the directory corresponding to the paging number of the latest paging call

4 Claims, 5 Drawing Sheets

MENU
1 : ALARM
2 : TIMER
3 : DIRECTORY SET

FIG. 5A

DIRECTORY
SETTING MODE
1 : HOME DIRECTORY
2 : AUTO CHANGE

FIG. 5B

HOME DIRECTORY
1 : 1-A
2 : 1-B
3 : 1-C

FIG. 5C

AUTO CHANGE DIRECTORY
1 : 1-A ON/OFF
2 : 1-B ON/OFF
3 : 1-C ON/OFF

FIG. 5D

DIR : 1-C
>ABCDEFG

FIG. 5E

DIR : 1-B
1 : BOOK
2 : CAR

FIG. 5F

DIR : 1-C
1 : ABCDEFG
2 : UCHIDA
3 : JUNE

FIG. 5G

DIR : 1-B
>12345678

FIG. 5H

DIR : 1-B
1 : 12345678
2 : BOOK
3 : CAR

FIG. 5I

RADIO PAGING RECEIVER WITH MESSAGE DISPLAYING FUNCTION AND METHOD OF CONTROLLING THE SAME

BACKGROUND OF THE INVENTION

1. Field of the Invention

This invention relates to a radio paging receiver, and more particularly to a radio paging receiver with a displaying function which stores messages accompanied by paging calls in directories provided with corresponding paging numbers, and displays stored messages in an arbitrary directory together and successively.

2. Description of the Prior Art

As an example of a conventional radio paging receiver with a message displaying function, a "Paging Receiver (Selective Call Receiver)" is disclosed in Japanese Patent Laid-Open No. 257127/92.

The paging receiver mentioned above has a plurality of paging number and received message information with paging calls are sorted and displayed together in accordance with call discrimination information corresponding to the paging numbers. In particular, when various information services are received by a single receiver in such a manner for instance that stock price information is received with a certain paging number while exchange rate information is received with another paging number, message information can be sorted and displayed together in accordance with the call discrimination information, and consequently, understanding or recognition of information from each information service is remarkably facilitated for a user.

However, the paging receiver cannot display the message information belonging to a particular information service preferentially to other message information.

SUMMARY OF THE INVENTION

It is an object of the present invention to provide a radio paging receiver and a method of controlling the paging receiver, wherein, when reception messages stored in directories corresponding to paging numbers are to be displayed from directory to directory, messages stored in a directory corresponding to a particular paging number can immediately be displayed with a priority according to the working mode setting by switch operation by the user of the paging receiver.

It is an object that the user can confirm messages sent through a particular paging number immediately at any time, or he can confirm messages sent through one of the selected paging numbers when a new message is displayed through the same number.

According to one aspect of this invention, there is provided a radio paging receiver with a message displaying function which has a plurality of paging numbers and stores messages accompanied by paging calls into directories provided individually corresponding to each of the paging numbers and displays the messages from directory to directory as occasion demands, the receiver comprising a priority or preferential display directory setting means for determining as a priority or preferential display directory among the directories the directory which has the highest priority or preferential ranking for displaying, and when the messages stored in the directories are to be displayed, the messages stored in the priority or preferential display directory determined by the priority or preferential display directory setting means are displayed together preferentially.

The priority or preferential display directory setting means may comprise a first priority or preferential display directory setting means for determining as the priority or preferential display directory the directory which corresponds to the paging number selected by an user of the radio paging receiver, and a second priority or preferential display directory setting means for determining as the priority or preferential display directory the directory from among the directories corresponding to a plurality of paging numbers selected by the user which corresponds to the paging number of the paging call that has occurred the latest, and the priority or preferential display directory may be determined by one of the first and second priority or preferential display directory setting means selected by the user.

According to another aspect of this invention, there is provided a method of controlling a radio paging receiver with a message displaying function which has a plurality of paging numbers and stores messages accompanied by paging calls into directories provided individually corresponding to each of the paging numbers and displays the messages from directory to directory as occasion demands, the method comprising the steps of selecting as a priority or preferential display directory from among the directories the directory which has the highest priority or preferential ranking for displaying, and displaying the messages stored in the priority or preferential display directory together preferentially when the messages stored in the directories are to be displayed.

The method may comprise a step of determining as the priority or preferential display directory the directory which corresponds to the paging number selected by an user of the radio paging receiver, or the directory from among the directories corresponding to a plurality of paging numbers selected by the user which corresponds to the paging number of the paging call which has occurred the latest.

BRIEF DESCRIPTION OF THE DRAWINGS

FIG. 5 is a schematic view showing display contents of a display unit in different steps shown in FIGS. 3 and 4.

DESCRIPTION OF THE PREFERRED EMBODIMENT

An embodiment of the present invention is described below with reference to the drawings.

Figure 1:
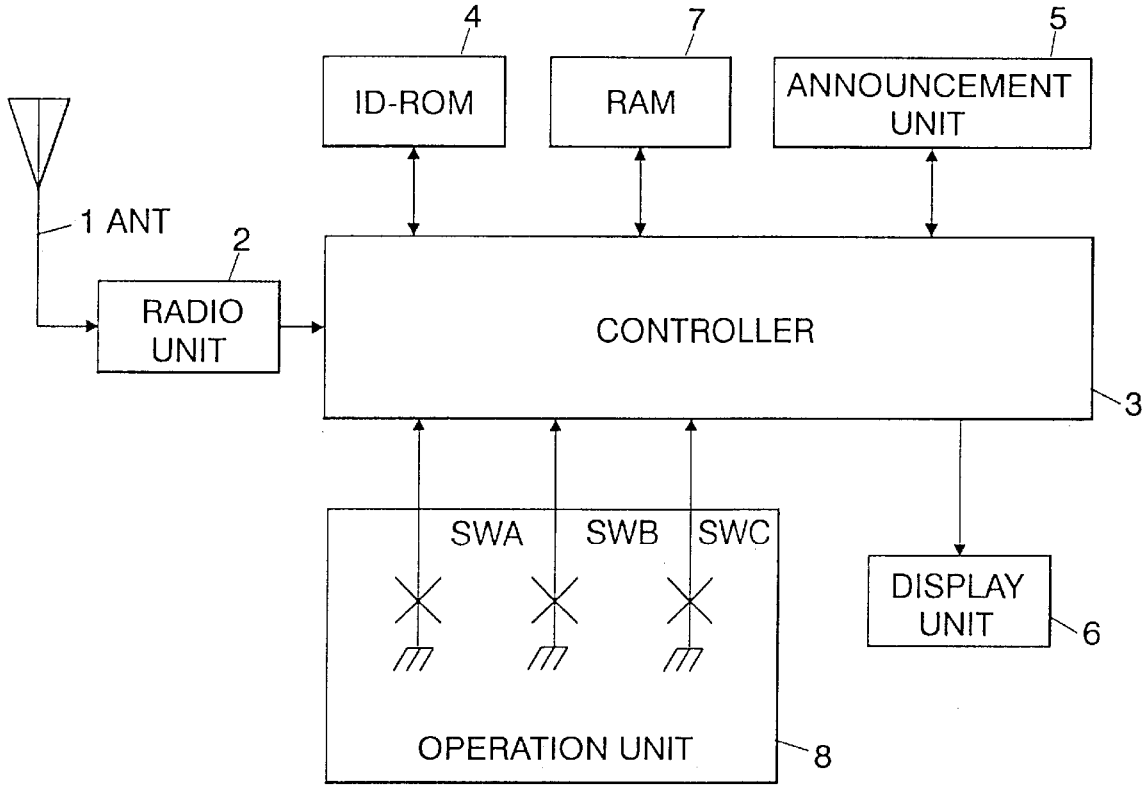
FIG. 1 is a block diagram showing an embodiment of a radio paging receiver with a message displaying function of the present invention.

Referring to FIG. 1, a radio paging receiver with message displaying function of the present embodiment includes antenna (ANT) 1, radio unit 2 for amplifying and demodulating a radio signal received by antenna 1, ID-ROM 4 for storing a plurality of paging numbers of the radio paging receiver, announcement unit 5 for announcing that the receiver is being called, display unit 6 for displaying a message of the received radio signal, RAM 7 for storing received messages in directories which correspond to paging numbers, operation unit 8 on which a plurality of switches (including a menu display switch (SWA), a settlement switch (SWB) and a selection switch (SWC)) operated by a user of the radio paging receiver are mounted, and controller 3 for controlling operation of the receiver such as confirmation and announcement of reception of paging calls to the receiver, and storing and displaying of the received messages in response to manual operation of switches of operation unit 8.

The user can, while observing the screen of display unit 6, manually operate a switch or switches of operation unit 8 to set a home directory mode and select a directory (home directory) which has the highest priority or preferential ranking for displaying among all the directories or to set an "AUTO CHANGE" mode and select a plurality of directories ("AUTO CHANGE" directories) to one of which the highest priority or preferential display ranking is automatically given in response to an occurrence situation of paging calls. In "AUTO CHANGE" mode, the preference is given to a directory among those selected directories which corresponds to a paging number of the latest paging call. Accordingly the priority or preferential display directory varies in response to an occurrence situation of paging calls.

Figure 2:
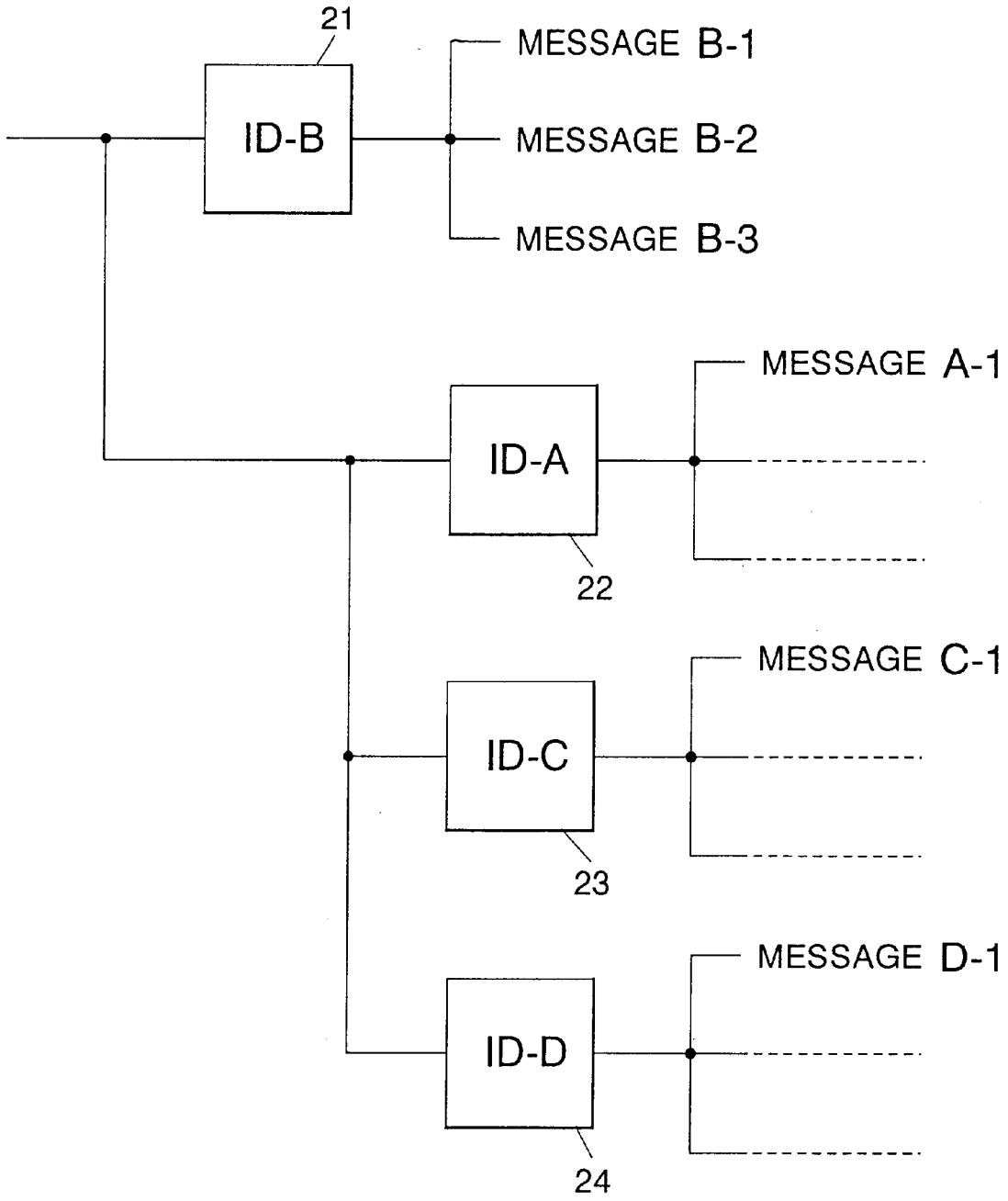
FIG. 2 is a diagrammatic view illustrating an example of a directory composition in a RAM of the radio paging receiver shown in FIG. 1.

FIG. 2 is a diagrammatic view illustrating an example of a directory composition in RAM 7.

For example, a home directory 21 has the highest priority or preferential display ranking, and ID-B denotes a paging number of home directory 21, and messages B-1, B-2 and B-3 are all messages stored in home directory 21.

Meanwhile, directories 22, 23 and 24 have ordinary display ranking other than the highest priority or preferential display ranking and have paging numbers ID-A, ID-B and ID-C, respectively. Further, messages A-1 and so forth, messages C-1 and so forth, and messages D-1 and so forth have been received and stored in the directories 22, 23 and 24 in RAM 7.

In the radio paging receiver shown in FIG. 1, when it is in a home directory mode, the user can depress a switch or switches of operation unit 8 to arbitrarily set a home directory corresponding to the paging number ID-B for example. However, when the radio paging receiver is in an "AUTO CHANGE" mode, he can set a plurality of "AUTO CHANGE" directories corresponding to paging numbers ID-A and ID-C for example, whose preferential display ranking are automatically determined in accordance with whichever paging number is that of the latest paging call received. In this instance, the preferential display directory is not fixed, but varies between ID-A and ID-C.

Next, operation of the switches and display contents are described in detail with reference to FIGS. 3, 4 and 5. It is to be noted that, in FIG. 5, reference symbols 1-A, 1-B and 1-C denote directories (DIR) corresponding to the paging numbers ID-A, ID-B and ID-C in FIG. 2, respectively.

First, a method of setting a home directory or "AUTO CHANGE" directories is described.

Figure 3:
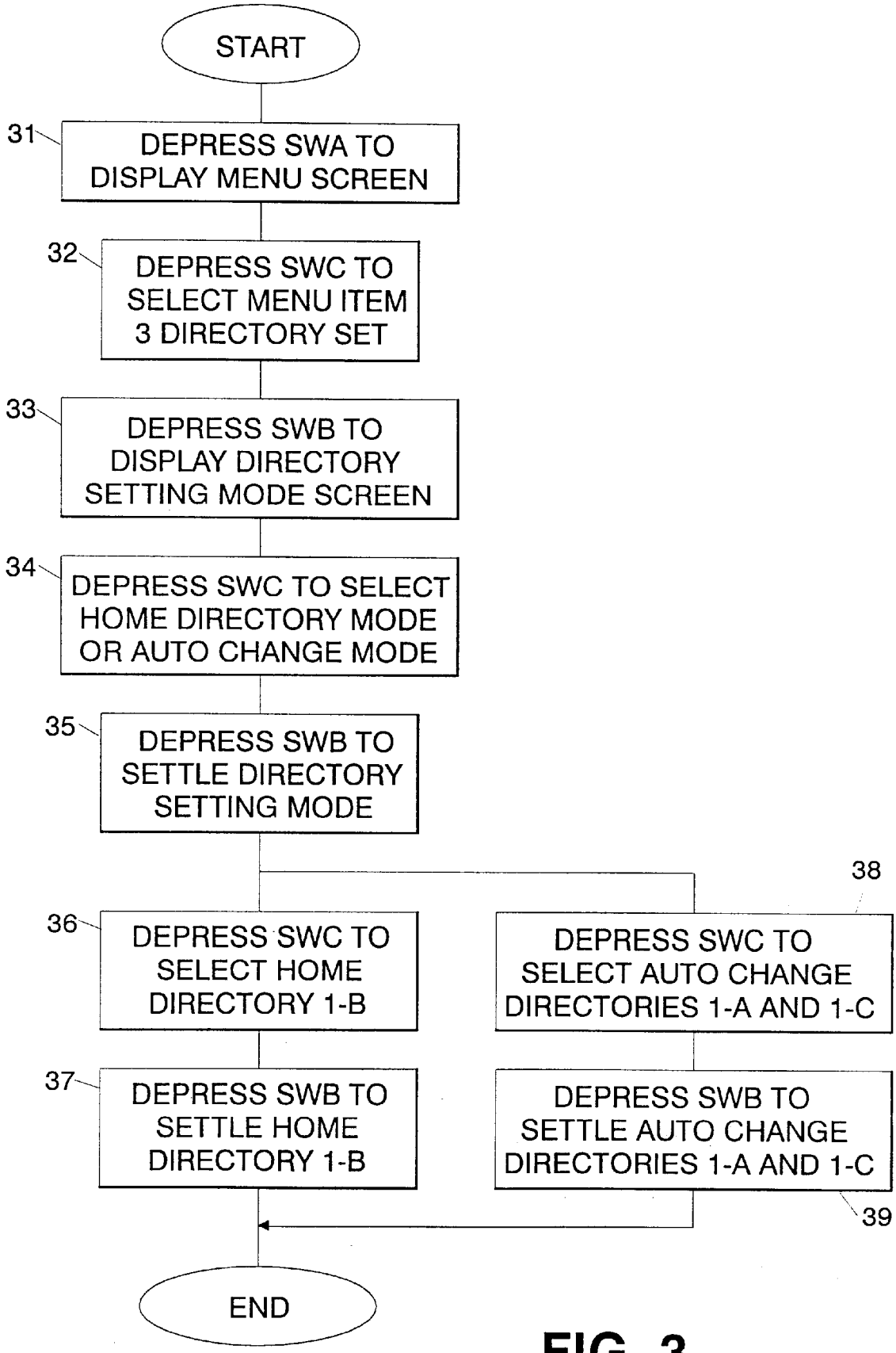
FIG. 3 is a flow chart illustrating a flow for setting of a home directory or "AUTO CHANGE" directories in the radio paging receiver shown in FIG. 1.
Figure 4:
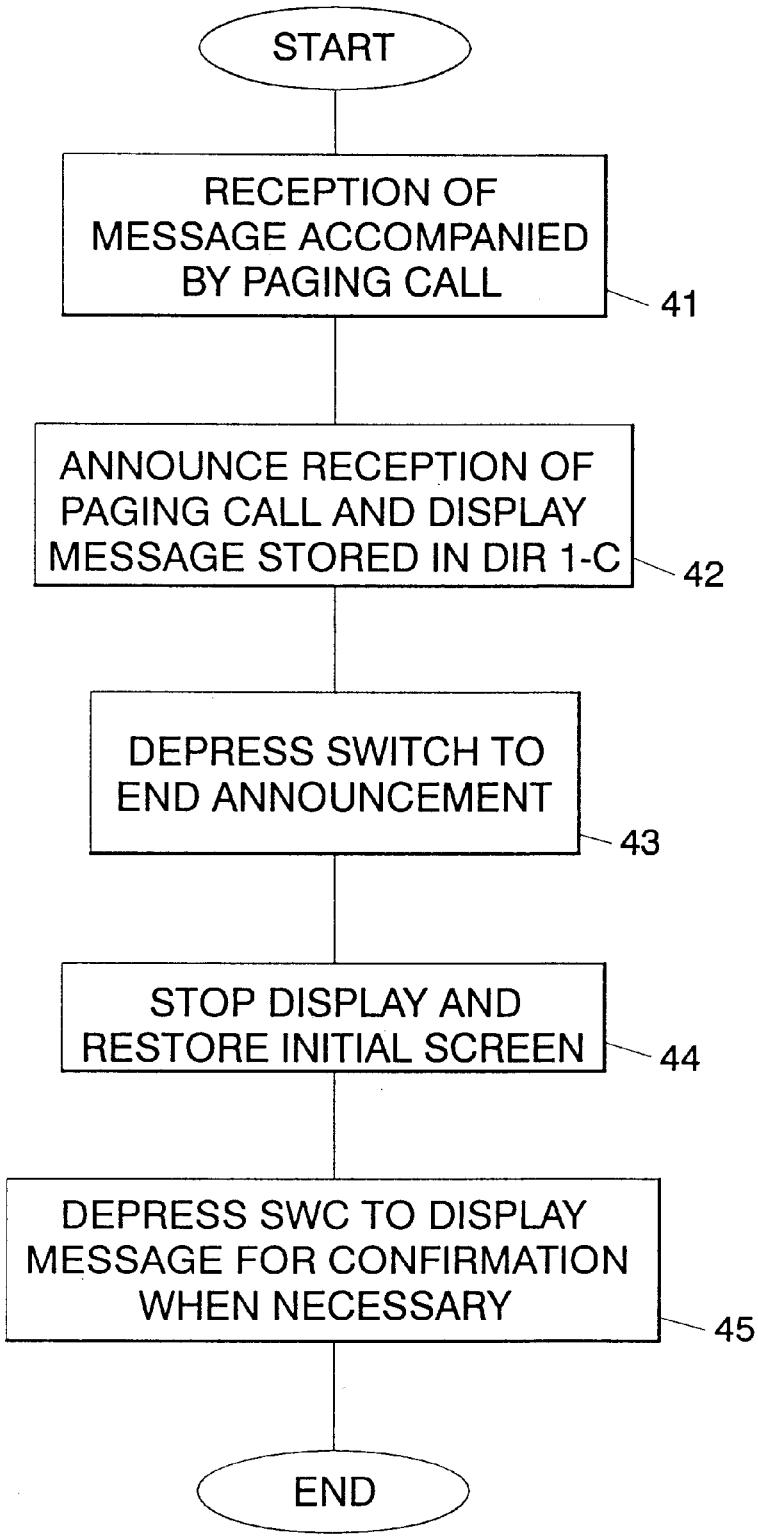
FIG. 4 is a flow chart illustrating a flow from reception of a message to displaying of the message for confirmation in the radio paging receiver shown in FIG. 1.

Referring to FIG. 3, if the user depresses switch SWA of operation unit 8, then "MENU" screen (FIG. 5(*a*)) is displayed on display unit 6 (step 31). Then, one of "1: ALARM", "2: TIMER" and "3: DIRECTORY SET" is selected by depression of switch SWC (step 32).

If the user selects "3: DIRECTORY SET" in this step 32 and then depresses switch SWB, then "DIRECTORY SETTING MODE" screen (FIG. 5(*b*)) is displayed on display unit 6 (step 33).

Then, the user depresses switch SWC to select one of "1: HOME DIRECTORY" mode and "2: AUTO CHANGE" mode (step 34) and depresses switch SWB to settle the result of the selection (step 35).

If the user selects "1: HOME DIRECTORY" mode in step 34 and then settles the selection in step 35, then "HOME DIRECTORY" screen (FIG. 5(*c*)) is displayed on display unit 6. Thereupon, if the user depresses switch SWC to select "2: 1-B" (step 36) and then depresses switch SWB to settle the selection, then setting of a home directory 1-B is completed thereby (step 37).

On the other hand, if the user selects "2: AUTO CHANGE" mode in step 34 and settles the selection in step 35, then "AUTO CHANGE DIRECTORY" screen (FIG. 5(d)) is displayed on display unit 6. Thereupon, if the user depresses switch SWC to select ON for "1: 1-A" and "3: 1-C" but keeps OFF for "2: 1-B" (step 38) and then depresses switch SWB to settle the selections, then setting of "AUTO CHANGE" directories 1-A and 1-C is completed thereby (step 39).

Next, a process from reception of a paging call to displaying of stored messages for confirmation is described with reference to FIG. 4.

If a message to be stored into directory 1-C is received for instance (step 41) after setting of a home directory 1-B or "AUTO CHANGE" directories 1-A and 1-C is completed in step 37 or step 39, whichever a "HOME DIRECTORY" mode or an "AUTO CHANGE" mode has been set, the directory name "DIR: 1-C" and a stored message ">ABCDEFG" in the same directory are displayed as seen in FIG. 5(*e*) at the time of announcing the reception of the paging call (step 42).

Then, if one of the switches of operation unit 8 is depressed, the announcement comes to an end (step 43) and the displaying is stopped and the waiting state (initial screen) is restored (step 44). The announcement of the reception of a paging call and the displaying of the messages stored as described above are performed for all paging calls received with messages irrespective of the display ranking.

Thereafter, when necessary, the user depresses the switch SWC to display the stored messages to confirm them (step 45). In the "HOME DIRECTORY" mode, if the home directory is set to directory 1-B, a message screen (FIG. 5(*f*)) of "DIR: 1-B" is displayed immediately on display unit 6. (Here, if the user depresses switch SWC to scroll the screen in order to confirm the messages of directory 1-C, then a message screen (FIG. 5(*g*)) of "DIR: 1-C" can be displayed.) On the other hand, in the "AUTO CHANGE" mode, if the latest message received and stored in the auto change directories 1-A and 1-C is the message stored in directory 1-C, when the user depresses switch SWC in step 45, directory 1-C takes preference and the message screen (FIG. 5(*g*)) of "DIR: 1-C" is displayed, thereby completing confirmation of the messages. In this instance, it is to be noted that messages 2: UCHIDA and 3: JUNE in FIG. 5(*g*) are messages received and stored after storing the message 1 ABCDEFG shown in FIG. 5(*e*).

In the "AUTO CHANGE" mode, when directory 1-B has been set to "OFF" in steps 38 and 39, even if one of the messages of directory 1-B is the latest message, the directory 1-B does not has the highest preferential ranking. In this mode, as described above, the messages stored in the directory 1-C (FIG. 5(*g*)) are displayed preferentially. (If the user depresses switch SWC to scroll the screen, then the messages of the directory 1-B (FIG. 5(*i*)) can be displayed.)

In this manner, it can be seen that a user who always wants to confirm the messages stored in a particular directory preferentially should use the home directory mode, but another user to whom the information stored in several selected directories are equally important should use "AUTO CHANGE" mode.

What is claimed is:

1. A radio paging receiver with a message displaying function which has a plurality of paging numbers comprising, a. means for storing messages accompanied by paging calls into a plurality of individual directories, with each individual directory corresponding to one of said paging numbers and storing a plurality of messages corresponding to that paging number;

b. means for displaying said messages from directory to directory as directed by a user of the radio paging receiver, and for displaying an individual directory by simultaneously displaying a plurality of messages in that individual directory;

c. a priority display directory setting means for determining an setting as a priority display directory the highest priority directory corresponding to the highest priority ranking for displaying; and d. when the messages stored in said directories are to be displayed, the plurality of messages stored in said priority display directory as determined by said priority display directory setting means are displayed first with a simultaneous display of the plurality of messages.

2. A radio paging receiver as claimed in claims 1, wherein said priority display directory setting means comprises:

a. a first priority display directing setting means for determining as said priority display directory one directory which corresponds to one paging number selected by the user of the radio paging receiver;

b. a second priority display directory setting means for determining as said priority display directory the directory from among, (i) a number of two or more directories, less than the number of directories in the full plurality of directories, which are selected by the user, (ii) and which also corresponds to the paging number of the paging call which has occurred most recently in time;

c. said priority display directory is determined by one of said first and second priority display directory setting means as selected by the user.

3. A method of controlling a radio paging receiver with a message displaying function which has a plurality of paging numbers, comprising, a. storing messages accompanied by paging cells into a plurality of individual directories, with each individual directory corresponding to one of said paging numbers and storing a plurality of messages corresponding to that paging number.

b. displaying said messages from directory to directory by a user of the radio paging receiver, and displaying and individual directory by simultaneously displaying a plurality of messages in that individual directory;

c. selecting and setting as a priority display directory the highest priority directory corresponding to the highest priority paging number which has the highest priority ranking for display, and d. when the messages stored in said directories are to be displayed, displaying the plurality of messages stored in said priority display directory first with a simultaneous display of the plurality of messages.

4. A method as claimed in claim 3, wherein said priority selecting and setting step further comprises:

a. a first method for determining as said priority display directory one directory which corresponds to one paging number selected by a user of the radio paging receiver;

b. a second method for determining as said priority display directory the directory from among, (i) a number for two or more directories, less than the number of directories in the full plurality of directories, which are selected by the user, (ii) and which also corresponds to the paging number of the paging call which has occurred most recently in time;

c. said priority display directory is determined by one of said first and second priority determining methods as selected by the user.

* * * * *

UNITED STATES PATENT AND TRADEMARK OFFICE

CERTIFICATE OF CORRECTION

PATENT NO. : 6,249,231 B1
DATED : June 19, 2001
INVENTOR(S) : J. Uchida

It is certified that error appears in the above-identified patent and that said Letters Patent is hereby corrected as shown below:

Title page,
Item [56], References Cited, U.S. PATENT DOCUMENTS, insert
-- 5,075,684 12/1991 DeLuca --
FOREIGN PATENT DOCUMENTS,
-- 0408660A1 2/7/1992 EPO
0675467A1 3/21/1995 PCT
93/09520 5/13/1993 PCT --

Column 1,
Line 20, "number" should read -- numbers --

Column 4,
Line 61, "have" should read -- has --

Column 5,
Line 28, "claims" should read -- claim --

Signed and Sealed this

Sixth Day of August, 2002

*Attest:*

*Attesting Officer*

JAMES E. ROGAN
*Director of the United States Patent and Trademark Office*